US006260226B1

(12) United States Patent
Specht

(10) Patent No.: US 6,260,226 B1
(45) Date of Patent: Jul. 17, 2001

(54) SELF-WRINGING FLAT MOP

(75) Inventor: Paul B. Specht, Wilmette, IL (US)

(73) Assignee: Freudenberg Household Products LP

( * ) Notice: Subject to any disclaimer, the term of this patent is extended or adjusted under 35 U.S.C. 154(b) by 0 days.

(21) Appl. No.: 09/474,597

(22) Filed: Dec. 29, 1999

(51) Int. Cl.[7] ..... A47L 13/144

(52) U.S. Cl. ..... 15/119.1; 15/119.2; 15/147.2; 15/228; 15/229.8; 15/244.2

(58) Field of Search ..... 15/116.1, 116.2, 15/119.1, 119.2, 147.2, 228, 229.6, 229.8, 244.2, 229.4

(56) References Cited

U.S. PATENT DOCUMENTS

| | | | | |
|---|---|---|---|---|
| 2,286,944 | * | 6/1942 | Altland | 15/119.1 |
| 2,740,146 | * | 4/1956 | Vaughn | 15/119.2 |
| 2,966,689 | * | 1/1961 | Antonucci, Jr. | 15/119.2 |
| 3,419,930 | * | 1/1969 | Grunert | 15/119.2 |
| 3,991,431 | * | 11/1976 | Thielen | 15/147.2 |
| 4,165,550 | * | 8/1979 | Burke | 15/229.8 X |
| 4,852,210 | * | 8/1989 | Krajicek | 15/228 |

FOREIGN PATENT DOCUMENTS

| | | | | |
|---|---|---|---|---|
| 323548 | * | 9/1957 | (CH) | 15/119.2 |
| 382754 | * | 10/1923 | (DE) | 15/119.1 |
| 3935649 | * | 5/1991 | (DE) | 15/147.2 |
| 451443 | * | 10/1991 | (EP) | 15/147.2 |
| 568110 | * | 11/1993 | (EP) | 15/228 |
| 1225875 | * | 7/1960 | (FR) | 15/116.2 |
| 396469 | * | 8/1933 | (GB) | 15/119.1 |
| 2206037 | * | 12/1988 | (GB) | 15/228 |
| 659037 | * | 12/1963 | (IT) | 15/119.2 |

* cited by examiner

*Primary Examiner*—Mark Spisich
(74) *Attorney, Agent, or Firm*—Leydig, Voit & Mayer, Ltd.

(57) ABSTRACT

Disclosed is a self-wringing flat mop. The mop includes a shaft having an operator end and a cleaning end, a plate disposed at the cleaning end of the shaft and being pivotally connected thereto, and a wringing mechanism. A liquid absorbent member such as a cleaning cover is disposed on the plate. The wringing mechanism includes a wringing handle that is disposed on the shaft and that is axially moveable with respect thereto, and a wringer connected to the wringing handle. When wringing the mop, the wringer handle is moved relative to the axis of the shaft to thereby move the wringer into a position to cover the plate and liquid absorbent member. In this position, the wringer exerts a force on the plate sufficient to compress the liquid absorbent member between the plate and the wringer.

15 Claims, 10 Drawing Sheets

SELF-WRINGING FLAT MOP

TECHNICAL FIELD OF INVENTION

The invention is in the field of cleaning implements, and more particularly is in the field of self-wringing mops.

BACKGROUND OF THE INVENTION

Numerous mops and cleaning utensils are known in the art. Conventional string mops comprise a handle and a mop head connected to one end of the handle, the mop head including numerous stands of a liquid absorbent material. Such mops require a wringer bucket or other wringing mechanism to expel liquid from the mop head. More recently, one trend in the mop art has been towards "self-wringing" mops, which are mops that themselves include a wringer or wringing mechanism of one type or another to enable a user to wring the mop without the need for a separate wringer bucket. For example, the prior art has provided roller sponge mops, butterfly sponge mops, twist mops (a generic term for self-wringing string mops), handle-type sponge mops, and the like.

The prior art also has provided flat mops, which are mops that have a liquid absorbent member covering a flat plate that is pivotally connected to the shaft of the mop. Such mops find favor with many consumers. Heretofore, to the best knowledge of the inventor, the prior art has not provided a flat mop that includes a self-wringing mechanism. Rather, in the flat mops of the prior art, the liquid absorbent member must be removed and wrung manually. The present invention is directed toward such a self-wringing flat mop.

THE INVENTION

The invention is directed toward a cleaning implement that may be used as a flat mop. The cleaning implement includes a shaft, a plate that is disposed at one end of the shaft and that is pivotally connected to the shaft, and a liquid absorbent member disposed on one side of the plate. In accordance with the invention, the mop further includes a wringing mechanism. The wringing mechanism includes a wringing handle that is disposed on the shaft and that is axially moveable with respect to the shaft, and a wringer, such as a wringer roller, that is operatively connected to the wringing handle and that is moveable over a range of travel between a non-wringing position and wringing position. In its wringing positions, the wringer exerts a compressive force on the plate, the force having a component normal to the surface of the plate when the plate is in the wringing position, such that the liquid absorbent member may be thereby compressed between the wringer and plate to expel liquid from the liquid absorbent member. Preferably, the wringer is connected to the wringing handle via a pair of tension rods that are connected to the wringing handle and that extend from the cleaning end thereof. In a highly preferred embodiment, each tension rod is curved to provide the compressive tension between the roller and the plate. The terminal portions of the rods form a wringer bearing. Each rod further terminates in a bent portion, such that the bent portions of the two rods together form a journal for a journalled wringer roller.

These and other features of the invention will be made apparent in view of the following description of the preferred embodiment and the appended claims.

DESCRIPTION OF THE PREFERRED EMBODIMENTS

Figure 1:
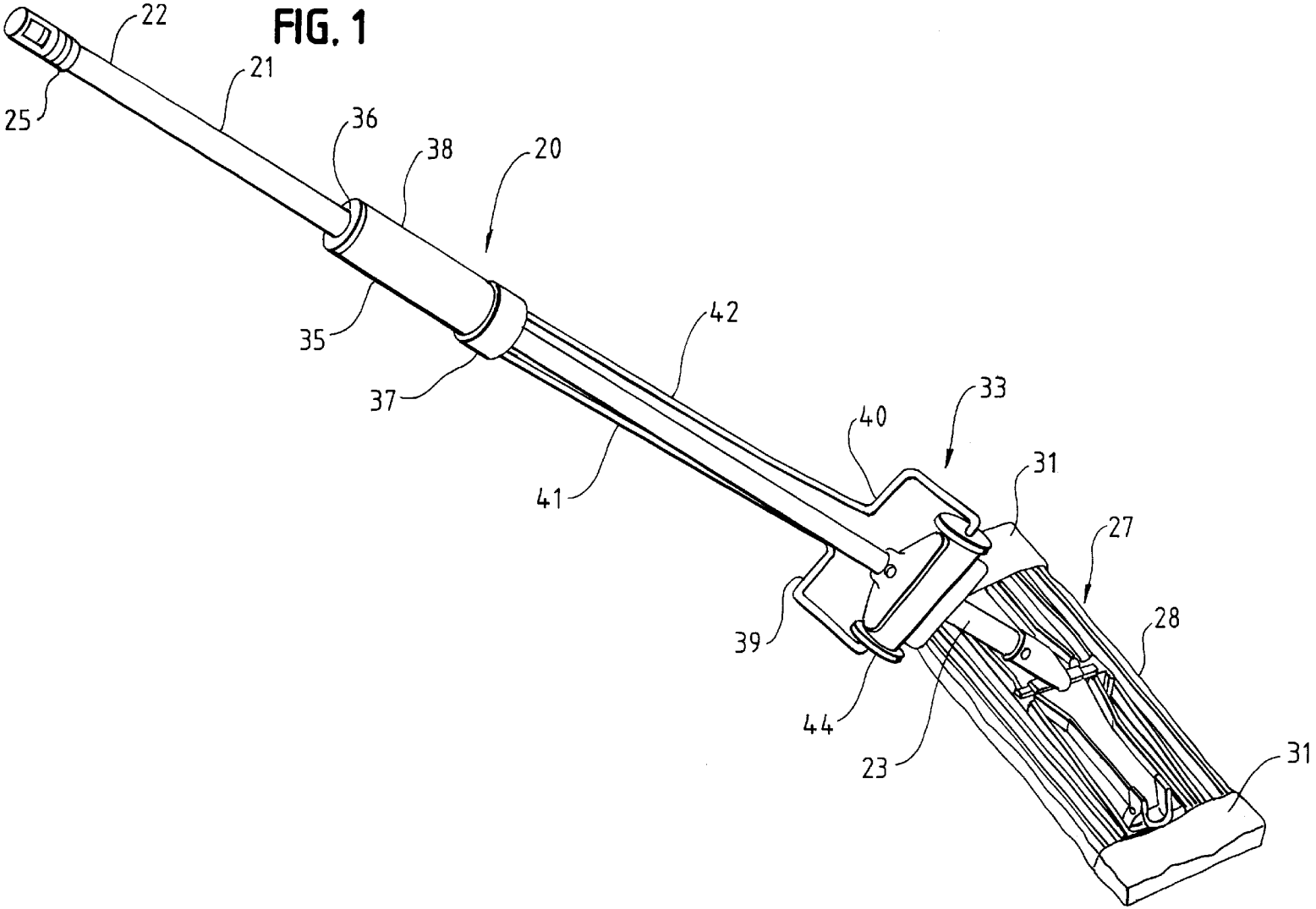
FIG. 1 is a perspective view of one embodiment of the cleaning implement of the invention.
Figure 2:
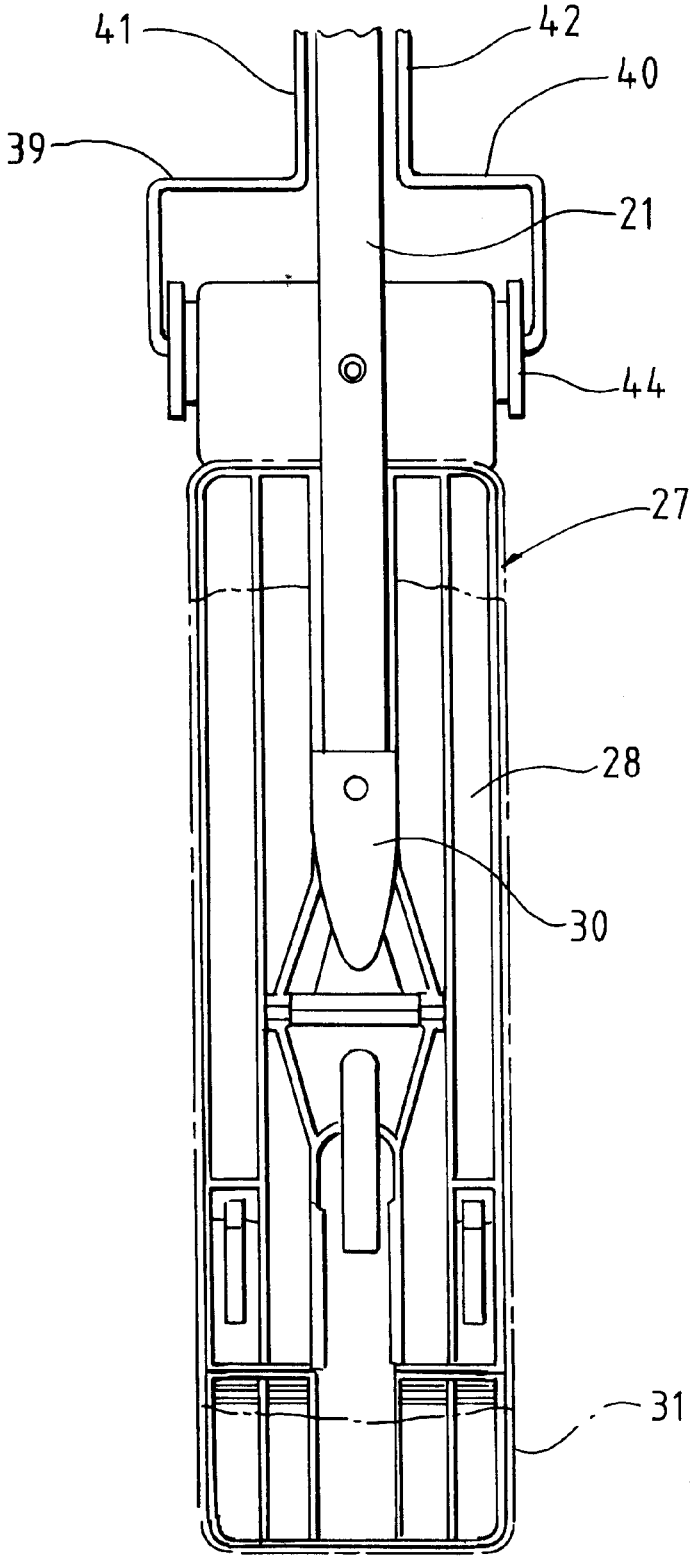
FIG. 2 is a front elevation of the cleaning implement illustrated in FIG. 1, shown with the plate in the wringing position and the wringer roller in a docked position.
Figure 3:
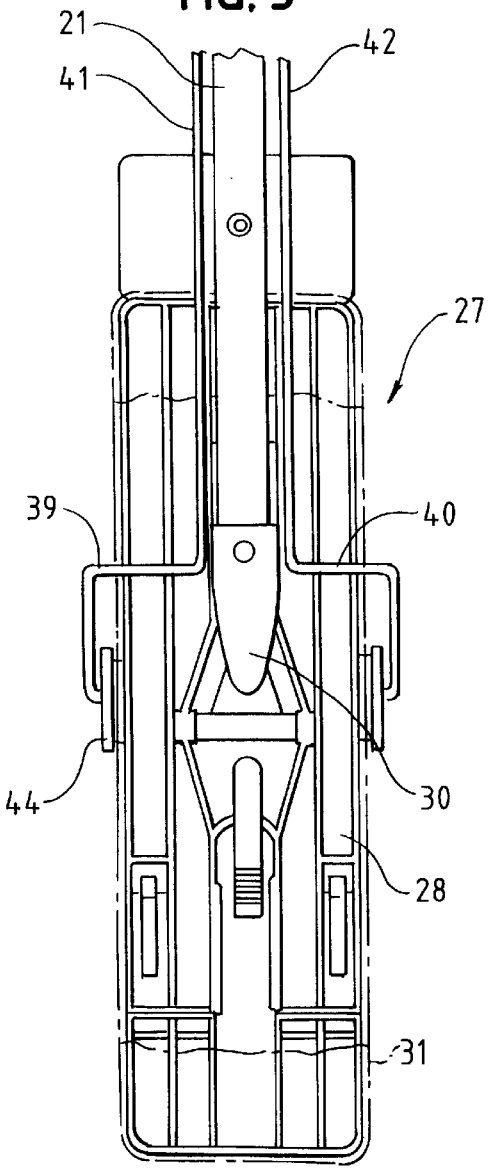
FIG. 3 is a front elevation of the cleaning implement shown in FIG. 1, illustrating the wringer roller in a wringing position.
Figure 4:
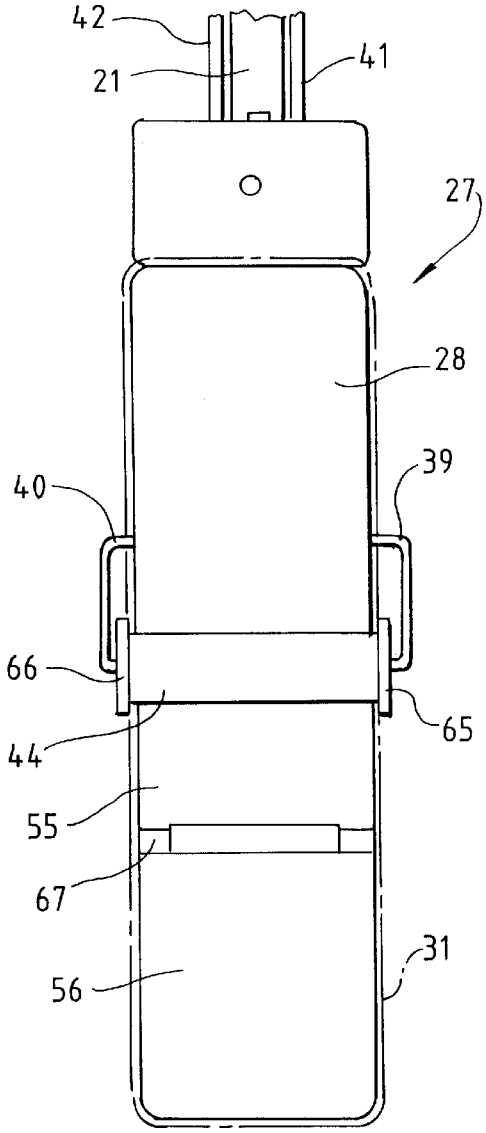
FIG. 4 is a rear elevation of the cleaning implement shown in FIG. 1, illustrating the plate in the wringing position and the wringer roller in a wringing position.

The cleaning implement of the invention is exemplified by the mop shown in the Figures. FIG. 1 shows a mop 20 including a shaft 21 which has an operator end 22 and a cleaning end 23. A hanger cap 25 is disposed at the operator end, and at the cleaning end is disposed a cleaning assembly 27. As shown in more detail in FIGS. 2–4, the cleaning assembly 27 comprises a plate 28 which has a shaft end (illustrated in FIGS. 2 and 3) and a cleaning end (illustrated in FIG. 4), and which is pivotally connected to the shaft 21 on the shaft end. The plate may be pivoted between cleaning positions (one of which is shown in FIG. 1) in which the cleaning implement may be used as a mop, and a wringing position (shown in FIGS. 2–4). Preferably, the shaft is connected to the plate by means of a universal joint 30 (shown in FIGS. 2 and 3) which allows pivotal motion of the plate 28 with respect to the shaft 21 in two directions perpendicular to the axis of the shaft. On the cleaning end of the plate 28 is disposed a liquid absorbent member which, in the illustrated embodiment, comprises a cleaning cloth 31 (shown in FIG. 1 and in phantom in FIGS. 2–4). The cleaning cloth 31 preferably is retained in a covering fashion over the cleaning end of the plate 28 via pockets in the cloth. The liquid absorbent member may take any other suitable form, for example, a sponge or the like.

Figure 5:
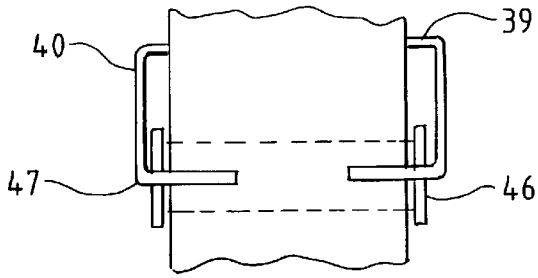
FIG. 5 is a front elevation of a portion of the cleaning implement shown in FIGS. 3 and 4.

In accordance with the invention, the mop further includes a wringing assembly 33 which comprises a wringing handle 35 (shown in FIG. 1) itself having an operator end 36 and a cleaning end 37. The wringer handle may have a grip 38 made of soft material disposed at the operator end of the handle. The wringing assembly further includes two tension rods 41, 42 that extend from the cleaning end 37 of the wringing handle. The cleaning end of each rod has an end portion 39, 40, shaped to accommodate the wringer which, in the illustrated embodiment, is a wringer roller 44. The rods thus together define a yoke-like bearing for the wringer roller 44. Each rod terminates in a bent portion 46, 47 (shown in FIG. 5), the bent portions together defining a journal for the wringer roller 44. The wringing handle and wringer may take other forms, and thus, for example, the wringing handle may be in the form of a first- or second-order lever mounted on the shaft, or the wringer may be a slider or other suitable wringer.

Figure 6:
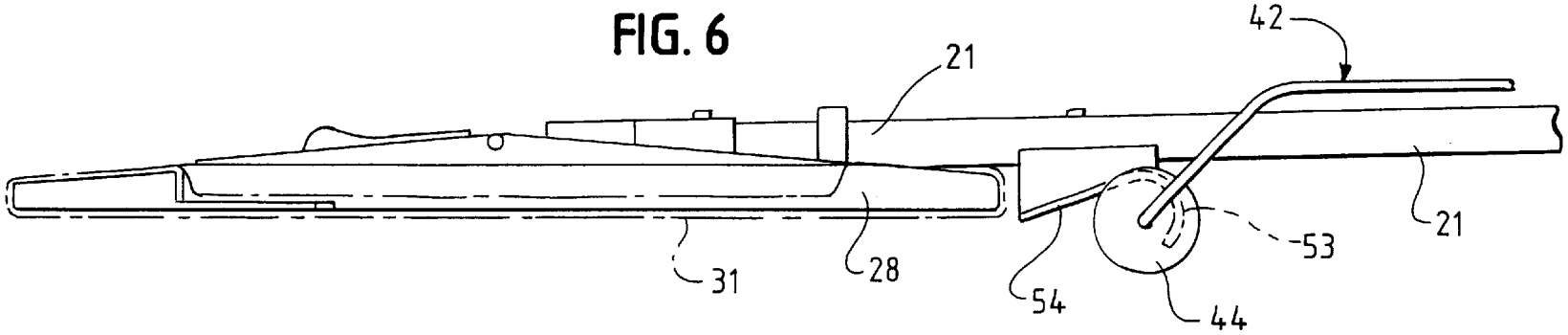
FIG. 6 is an enlarged side view of the cleaning implement shown in FIG. 1, illustrating the wringer roller in its docked position.
Figure 7:
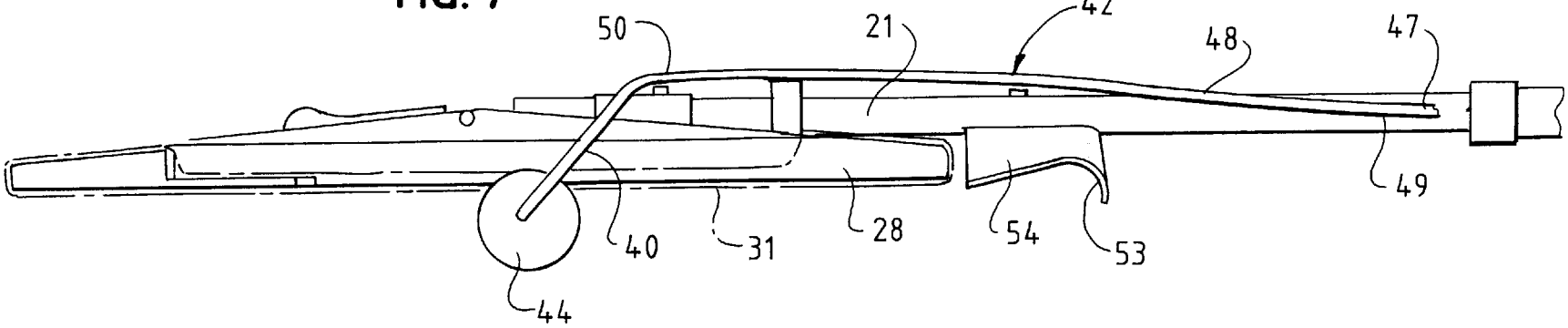
FIG. 7 is an enlarged side view of the cleaning implement shown in FIG. 1, illustrating the wringer roller in a wringing position.

As seen in more detail in FIGS. 6 and 7, tension rod 42 is curved with respect to the axis of the shaft 21 and is fashioned to bias the roller 44 against the plate 28. The bias of the roller 44 on the plate 28 causes the roller 44 to impart sufficient compressive force on the plate 28 when actuated to expel liquid from the liquid absorbent member. The force exerted by the roller on the plate need not be normal to the surface of the plate, so long as the force has a component in the direction normal to the surface of the plate. As shown in FIG. 7, the tension rod 42 has a first portion 47, an intermediate slightly curved portion 48 that is separated from the first portion 47 by a first bend 49, and a second bend 50 that separates the intermediate portion 48 from the end portion 40. The tension component in the rod normal to the plate is created by the first and second bends 49, 50.

To expel water from the liquid absorbent member, i.e., to wring the mop, the plate 28 is brought to its wringing position with respect to the shaft (as shown in FIG. 6). The wringing handle 35 (not shown in FIGS. 6 and 7) is axially movable with respect to the shaft over a range of travel between a non-wringing position and wringing positions. FIG. 6 illustrates the wringing roller 44 in its non-wringing position, wherein, as shown, the roller rests in a curved end cavity 53 of a dock 54 which is affixed to the shaft 21. After bringing the plate into its wringing position, the user then manually moves the wringing handle axially toward the cleaning end of the shaft 21, thereby causing the roller 44 to pass into its wringing positions in which the roller 44 covers the plate 28 and cleaning cloth 31 (as shown in FIG. 7). In this position, the liquid absorbent member 31 is caused to become compressed between the plate and roller.

Figure 8:
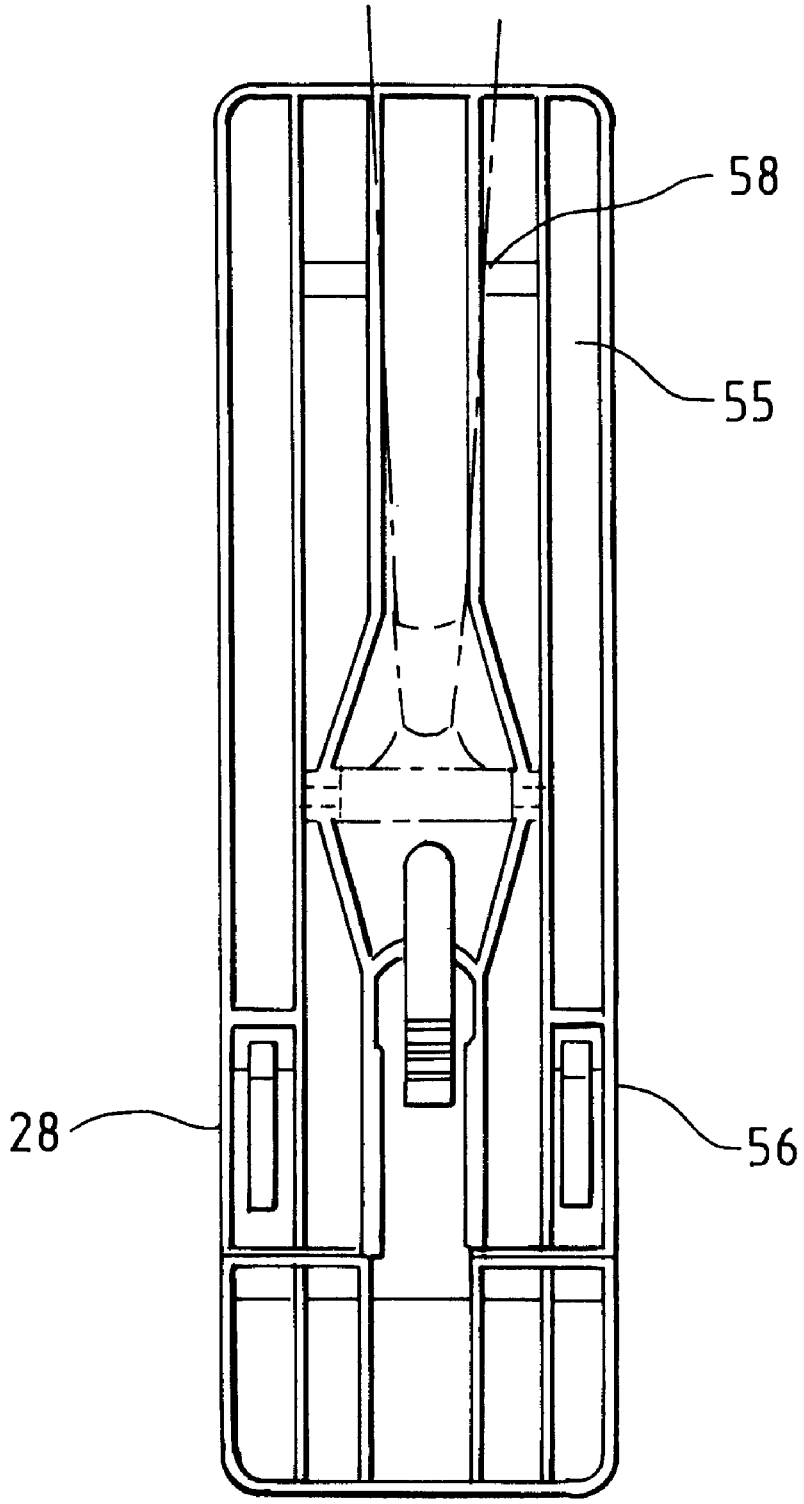
FIG. 8 is a plan view of the shaft end of the plate of the cleaning implement shown in FIG. 1.
Figure 9:
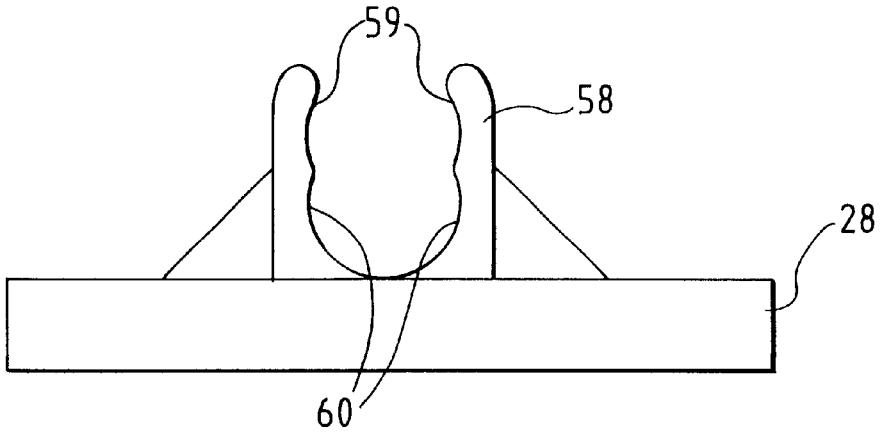
FIG. 9 is an enlarged front elevation of the plate shown in FIG. 8.
Figure 10:
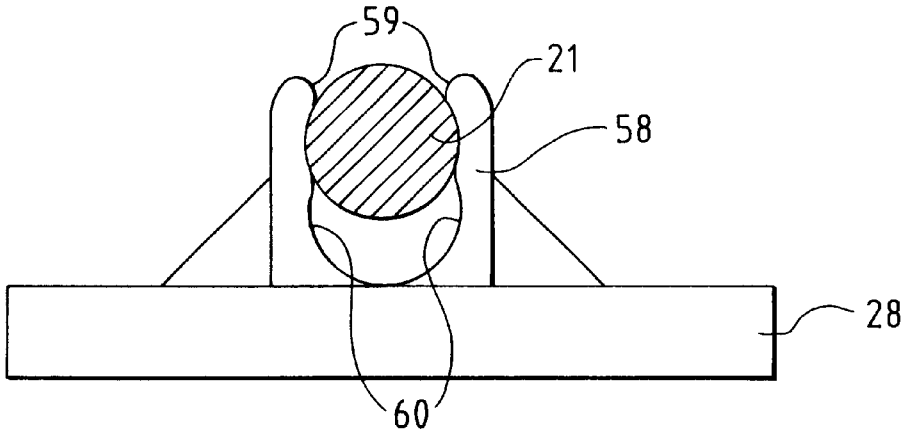
FIG. 10 is an enlarged front elevation of the plate shown in FIG. 8, illustrating the plate in a first locked position on the shaft.
Figure 11:
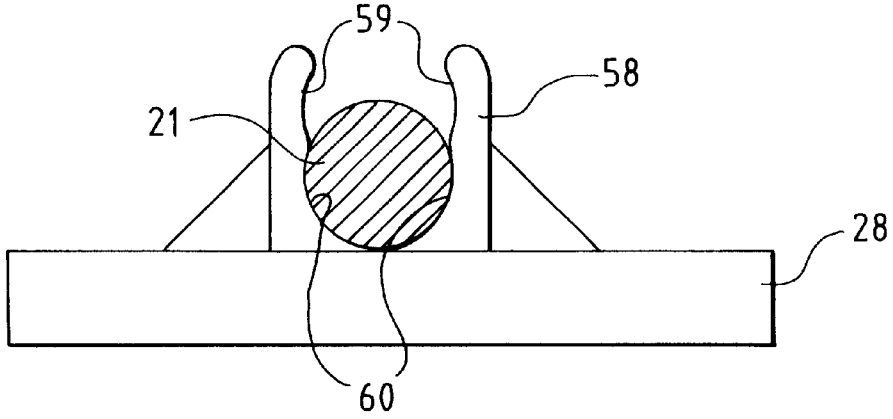
FIG. 11 is an enlarged front elevation of the plate shown in FIG. 8, illustrating the plate in the wringing position on the shaft.

In carrying out the invention, a plate 28 such as that shown in FIGS. 8–11 is provided. As shown in FIG. 8, the plate 28 includes a major portion 55 and a toe portion 56 (see also FIG. 4). The major portion 55 includes a clip 58 (best shown in FIGS. 9–11) which, in the illustrated embodiment, is a double acting clip. The clip has a first portion 59 and a second portion 60 (as shown in FIG. 9). In other embodiments of the invention, the clip may be a single action clip. The purpose of the clip is to retain the plate in a fixed position with respect to the shaft, at least when the plate is in its wringing position. The plate may be brought to its wringing position by grasping the shaft 21 at its operator end and moving the shaft 21 with respect to the plate until the shaft 21 is retained by the first portion 59 of the clip 58, as shown in FIG. 10. The user then may further move the shaft 21 with respect to the plate 28 to retain the plate in the second portion 60 of the clip 58, and to thereby place the plate 28 into the wringing position, as shown in FIG. 11. The clip arms are sufficiently resilient to allow the user to manually engage and disengage the shaft from the clip. It should be appreciated that the wringing method mechanism also may operate when the plate is in a position other than its wringing position as, for example, when the plate is in the position shown in FIG. 10.

Figure 12:
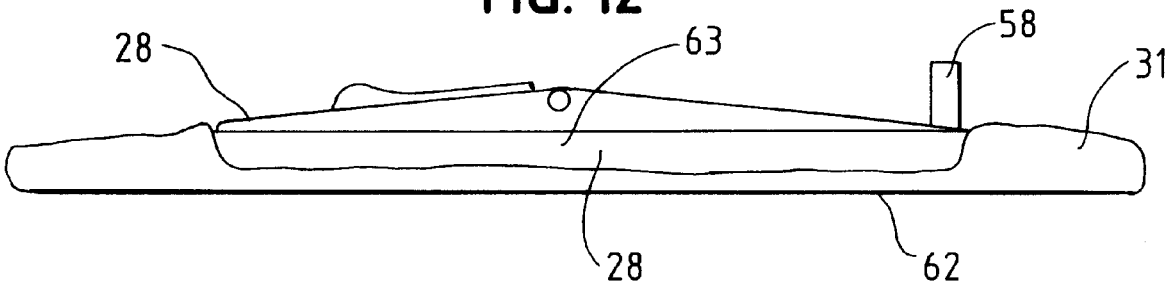
FIG. 12 is an enlarged side elevation of the plate shown in FIG. 8.

As shown in FIG. 12, the cleaning cloth 31 preferably includes side portions (one side portion 62 being shown in FIG. 12) that extends at least partially around the cleaning end of the plate 28 and over the side 63 of the plate to thereby prevent the plate itself from contacting walls and furniture when in use. When wringing the mop, the rim ends 65, 66 (shown in FIG. 4) of the roller 44 engage the side portions and compress the side portions between the rim ends and the sides of the plate.

Figure 13:
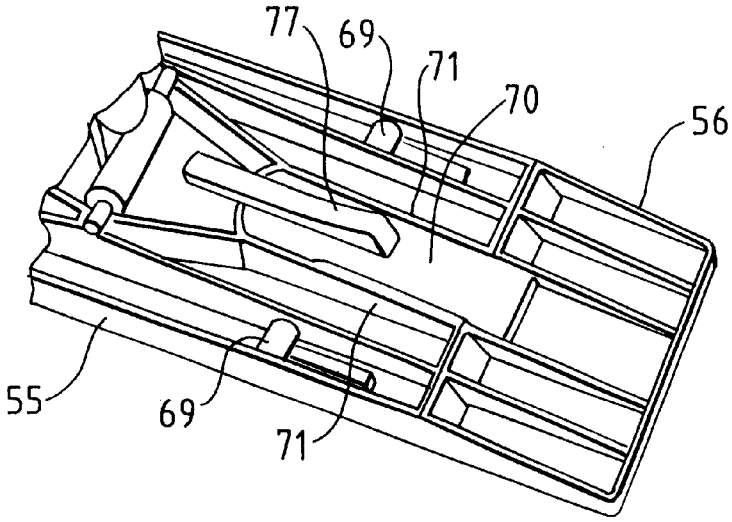
FIG. 13 is an enlarged perspective view of the toe portion of the plate shown in FIG. 8.
Figure 14:
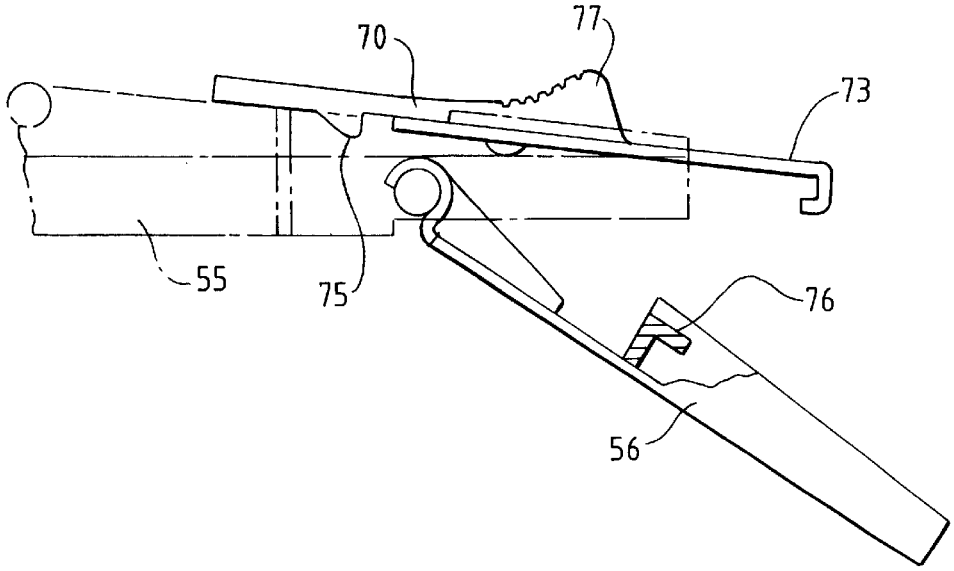
FIG. 14 is a side elevation, partially cut away, of the toe portion of the plate, illustrating the slide bar in the unlatched position.
Figure 15:
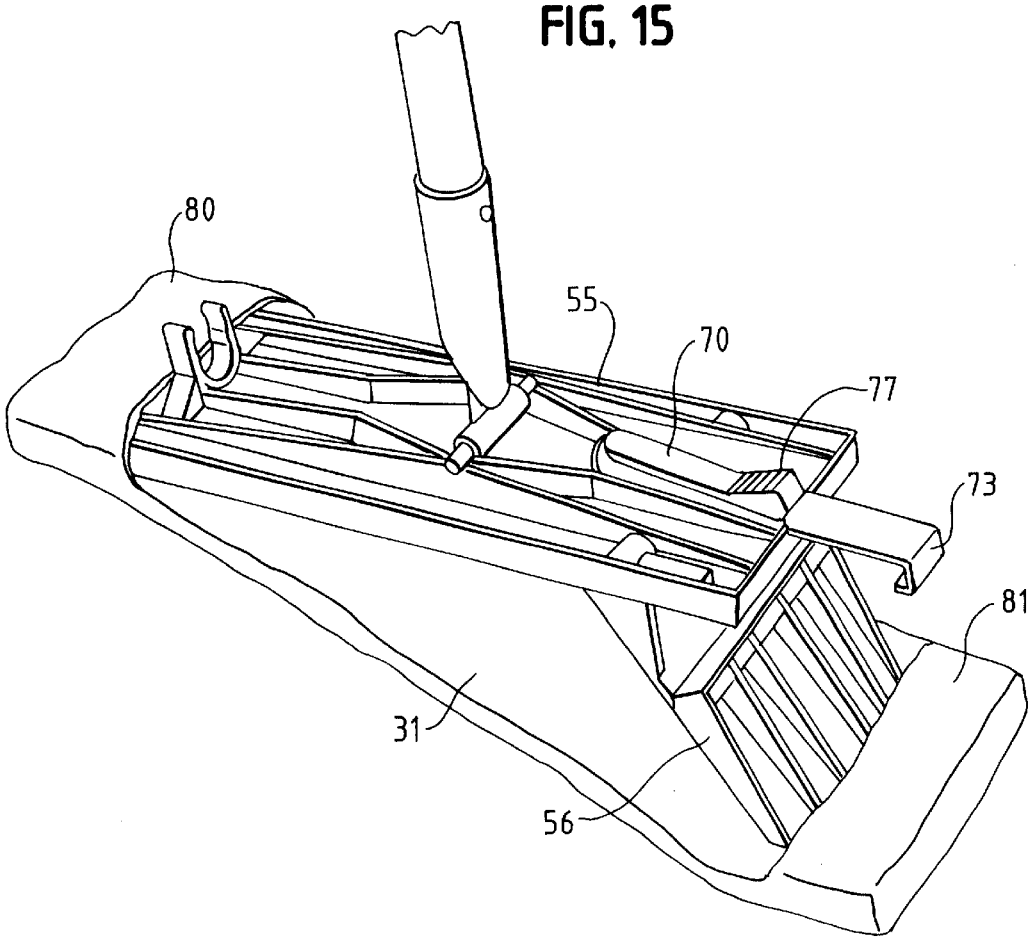
FIG. 15 is an enlarged perspective view of the toe portion of the plate, illustrating the toe portion in a cover mounting position.
Figure 16:
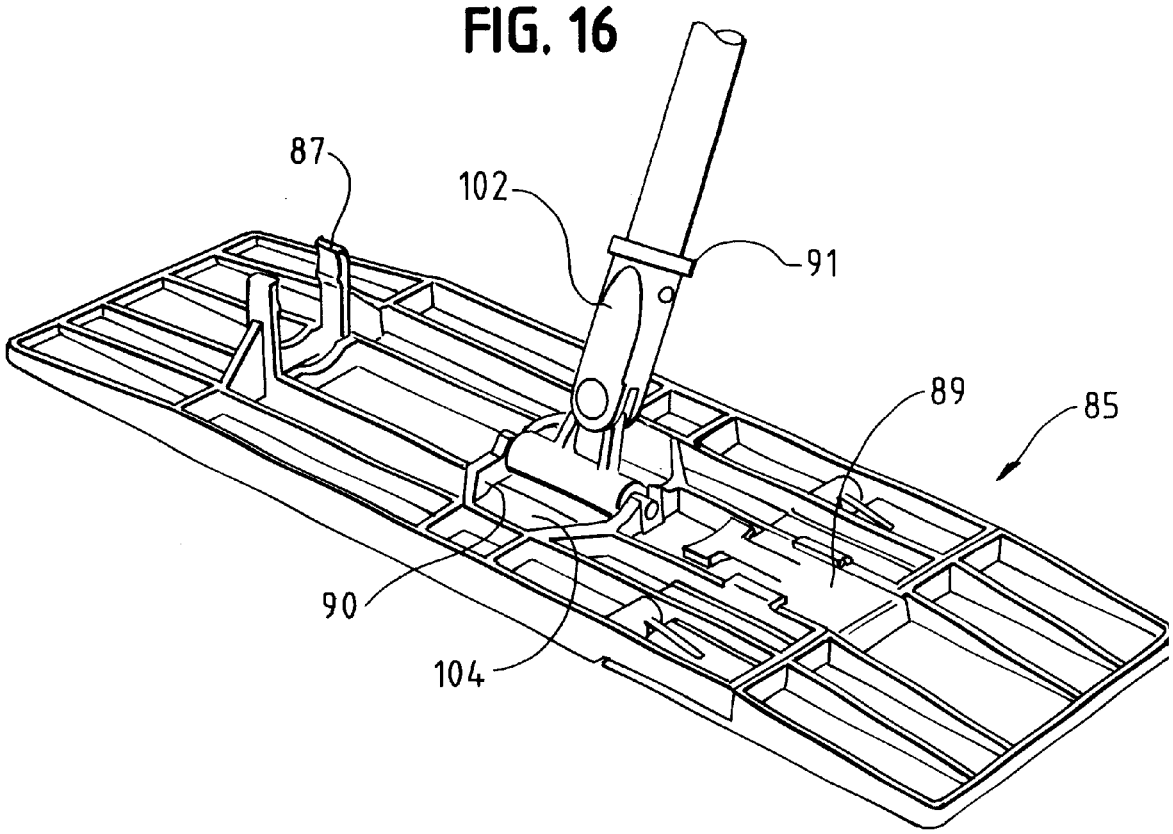
FIG. 16 is a perspective view of an alternative embodiment of the plate.

The toe portion 56 of the plate 28 is hinged to the major portion 55, as illustrated in more detail in FIGS. 13–15. A hinge pin 67 (shown in FIG. 4) runs between knuckles 69 (shown in FIG. 13) on the major portion and the toe portion. In normal use, the toe portion 56 is locked via a locking slide bar 70 into a position substantially coaligned with the major portion 55 and affixed with respect thereto, as shown in FIG. 13. The slide bar 70 rides in a track 71, and includes a toe end latch 73 and a plate latch 75 (shown in FIG. 14). As shown in more detail in FIG. 14, the toe end latch 73 is oriented to engage a striker plate 76 on the toe portion 56 when the toe portion is in its normal operating position (not shown in FIG. 14). The slide bar 70 further includes a grip 77 to allow a user to slide the bar in the track 71. The plate latch 75 prevents the slide bar 70 from sliding off of the major portion 55 of the plate, and also secures the plate in its latched position (not shown).

To remove the cover, the slide bar latch 73 is disengaged from the striker plate 76 by lifting and sliding the slide bar 70 toward the toe end of the plate. The toe portion then may be pivoted with respect to the major portion, as shown in FIGS. 14 and 15, to allow the user to remove the cleaning cloth 31 for cleaning. To replace the cover, the major portion 55 and toe portion 56 of the plate are placed within the pockets 80, 81 of the cloth, the toe portion 56 is brought back into its normal operating position, and the slide bar 70 is retracted into its locked position to thereby retain the cloth 31 over the plate and the toe portion on its normal operating position.

Figure 17:
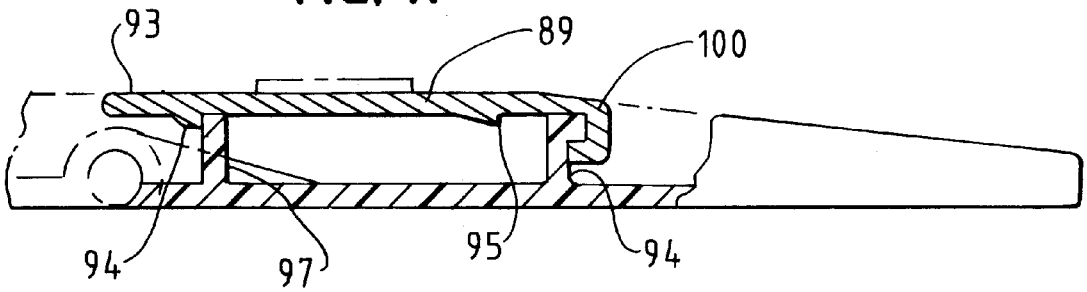
FIG. 17 is an enlarged side elevation, partially cut away, of the toe portion of the plate shown in FIG. 16, illustrating the slide bar in its latched position.
Figure 18:
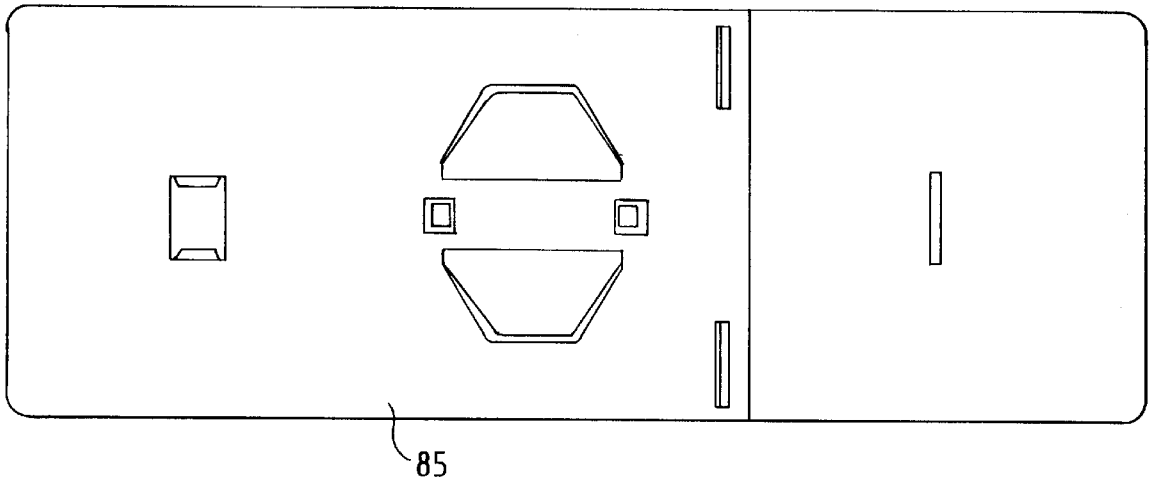
FIG. 18 is a bottom view of the plate shown in FIG. 16.
Figure 19:
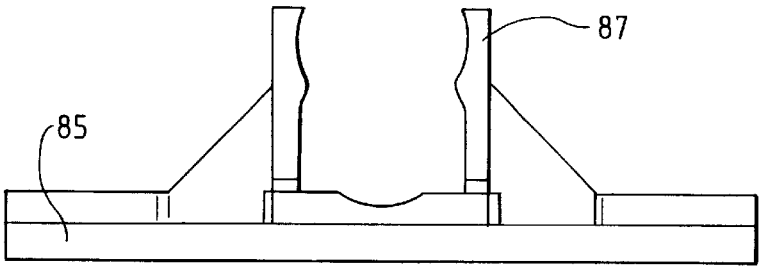
FIG. 19 is an enlarged front elevation of the plate shown in FIG. 16.

An alternative embodiment of the plate for the cleaning implement of the invention is shown in FIGS. 16–19. The plate 85 has a clip 87, slide bar 89, and mount 90 for universal joint 91. The universal joint 91 has a surface 102 which engages a ramped surface 104 on the plate 85 to thereby limit the range of travel of the mop shaft (the other side of the universal joint being similarly configured). As shown in FIG. 17, the slide bar 89 has a tab end 93 with first and second plate latches 94, 95. The slide bar 89 may be disengaged by lifting the toe end such that the first plate latch 94 clears the catch 97. The plate further includes a striker plate 99 and toe end latch 100 on the slide bar 89.

The shaft preferably is made of a metal such as aluminum, the tension rods preferably are made of a spring steel, and the other components of the mop preferably are made of injection mold engineering grade plastic or other material suitable for use conjunction with the preparation of cleaning implements. The component parts of the mop may be made and assembled via conventional techniques.

It is thus seen that the present invention provides a self-wringing flat mop. The invention further encompasses other cleaning implements, and the cleaning implement of the invention may be used for dusting or other cleaning purposes.

While a particular embodiment of the invention has been shown, the invention is not limited thereto, and indeed the invention is susceptible to various modifications. The invention is therefore deemed to encompass the subject matter defined by the following claims and equivalents thereof.

What is claimed is:

1. A cleaning implement comprising:

a shaft having an operating end and a cleaning end;

a plate having a shaft side and a cleaning side and being pivotally connected to said shaft at said cleaning end and movable over a range of travel between a wringing position and non-wringing positions, said plate further having a toe portion and a major portion, said toe portion being hingedly connected to said major portion;

a liquid absorbent member disposed on the cleaning side of said plate;

a wringing mechanism including a wringing handle disposed on said shaft and being movable with respect thereto; said wringing mechanism including a wringer connected to said wringing handle and covering said plate and compressing said liquid absorbent member to said plate.

2. A cleaning implement according to claim 1, said plate being connected to said shaft via a universal joint which allows pivotal movement of said plate relative to said shaft in two directions perpendicular to the axis of said shaft.

3. A cleaning implement according to claim 1, said plate being fixed relative to said shaft when said plate is in said wringing position.

4. A cleaning implement according to claim 1, wherein said wringer is a roller.

5. A cleaning implement according to claim 4, said wringing handle being moveable to a fully retracted position, said shaft including a dock fixedly disposed thereon and receiving said roller when said wringing handle is in said fully retracted position.

6. A cleaning implement according to claim 4, said wringing mechanism including a pair of tension rods connecting said roller to said wringing handle, each of said rods terminating in a bent portion, the bent portions forming a journal for said roller.

7. A cleaning implement according to claim 1, said plate including a clip for affixing said plate relative to said shaft.

8. A cleaning implement according to claim 1, said liquid absorbent member comprising a cover having first and second pockets receiving first and second ends respectively of said plate to thereby retain said cover on said plate.

9. A cleaning implement according to claim 1, said plate further including a locking bar, said locking bar being slidable with respect to said plate and terminating in a toe latch, said toe latch releasably engaging a striker portion on said toe portion when said toe portion is in an operating position thereby affixing said toe portion relative to said major portion.

10. A cleaning implement comprising:

a shaft having an operating end and a cleaning end;

a plate having a shaft side and a cleaning side and being pivotally connected to said shaft at said cleaning end and movable range of travel between a wringing position and non-wringing positions;

a liquid absorbent member disposed on the cleaning side of said plate;

and a wringing mechanism with a wringing handle disposed on shaft and being movable with respect thereto; said wringing mechanism including:

a roller connected to said wringing handle and covering said plate and compressing said liquid absorbent member to said plate, said wringing mechanism including a pair of tension rods connecting said roller to said wringing handle, each of said rods terminating in a bent portion, the bent portions forming a journal for said roller.

11. A cleaning implement according to claim 10, said plate being connected to said shaft via a universal joint which allows pivotal movement of said plate relative to said shaft in two directions perpendicular to the axis of said shaft.

12. A cleaning implement according to claim 10, said plate being fixed relative to said shaft when said plate is in said wringing position.

13. A cleaning implement according to claim 10, said wringing handle being moveable to a fully reacted position, said shaft including a dock fixedly disposed thereon and receiving said roller when said wringing handle is in said fully retracted position.

14. A cleaning implement according to claim 10, said plate including a clip for affixing said plate relative to said shaft.

15. A cleaning implement according to claim 10, said liquid absorbent member comprising a cover having first and second pockets receiving first and second ends respectively of said plate to thereby retain said cover on said plate.

* * * * *